United States Patent [19]

Gardner

[11] 4,075,851

[45] Feb. 28, 1978

[54] PENSTOCKS

[75] Inventor: Frederick Basil Gardner, Redditch, England

[73] Assignee: Simon-Hartley Limited, England

[21] Appl. No.: 679,730

[22] Filed: Apr. 23, 1976

[30] Foreign Application Priority Data

May 6, 1975 United Kingdom ..... 19037/75

[51] Int. Cl.[2] ..... E02B 7/54

[52] U.S. Cl. ..... 61/22 A; 49/475; 49/506; 264/261; 264/269; 427/239

[58] Field of Search ..... 61/22 A, 22 R, 28; 49/475, 489, 506; 428/358; 427/239; 264/261, 263, 269; 156/242

[56] References Cited

U.S. PATENT DOCUMENTS

| | | | |
|---|---|---|---|
| 2,599,440 | 6/1952 | Dudley | 20/69 |
| 2,683,354 | 7/1954 | Marza | 61/28 |
| 2,782,887 | 2/1957 | Zimmermann | 49/489 |
| 2,835,924 | 5/1958 | Schmeling | 49/489 |
| 2,984,074 | 5/1961 | Le Clair et al. | 61/28 |
| 3,170,967 | 2/1965 | Williams et al. | 49/489 |

*Primary Examiner*—Paul R. Gilliam
*Assistant Examiner*—Alex Grosz
*Attorney, Agent, or Firm*—Norris & Bateman

[57] ABSTRACT

A penstock comprising a frame having an opening therein and a door slidable within the frame across said opening to close same by vertical movement between fixed vertical guide members slidably engaging the side edge regions of said door, wherein at least one of said members at each side forms a resilient vertical seal, said penstock including a base invert seal which is produced by temporarily and at least partially compressing said resilient vertical seal, forming a pad of resilient material onto which the lower edge of the door in use will close and causing said resilient material to form a seal around the lower end region of the resilient vertical seal prior to releasing the temporary compressive force applied to the latter, the resilient pad being preferably formed by introducing the material in liquid form into a channel defined by limit strips such that the liquid flows around the lower end region of said resilient vertical seal to become bonded thereto, said compressive force being maintained until the liquid is cured.

13 Claims, 6 Drawing Figures

PENSTOCKS

This invention relates to penstocks of the kind comprising a frame having an opening therein and a door slidable vertically within the frame across said opening to close same, and is particularly, though not exclusively, concerned with the kind of penstock adapted to be located in a river or channel or other watercourse and wherein the bottom cross member of the frame known as the base invert, is disposed substantially flush with the bed over which the water passes.

It is necessary in most cases to ensure that a tight seal is provided around the door when closed to prevent leakage past the penstock, and particular difficulties arise in preventing leakage around the sides of the door and under the lower edge thereof especially at the lower corners where the seal faces changes from the vertical to the horizontal.

An object of the present invention is to provide a penstock wherein the aforementioned difficulties are at least substantially overcome.

According to the present invention there is provided a method of producing a base invert seal in a penstock, the penstock comprising a frame having an opening therein and a door slidable within the frame across said opening to close same by vertical movement between fixed vertical guide members slidably engaging the side edge regions of said door, wherein at least one of said members at each side form a resilient vertical seal, the method comprising the steps of temporarily and at least partially compressing said resilient vertical seal, forming a pad of resilient material onto which the lower edge of said door in use will close and causing said resilient material to form a seal around the lower end region of said resilient vertical seal prior to releasing the temporary compressive force applied thereto.

Preferably said pad of resilient material is formed by introducing the material in liquid form into a channel defined by limit strips such that said liquid flows around the lower end region of said resilient vertical seal to become bonded thereto, said compressive force being maintained until said liquid has cured.

Further according to the invention there is provided a penstock having a base invert seal produced according to the aforesaid method, and comprising a frame having an opening therein and a door slidable within the frame across said opening to close same by vertical movement between fixed vertical guide members slidably engaging the side edge regions of said door, wherein at least one of said members at each side forms a resilient vertical seal, said base invert seal comprising a pad of resilient material forming a seal against said frame base and around the lower end region of said resilient vertical seal.

An embodiment of the invention will now be described by way of example only, with reference to the accompanying drawings, in which.

Figure 1:
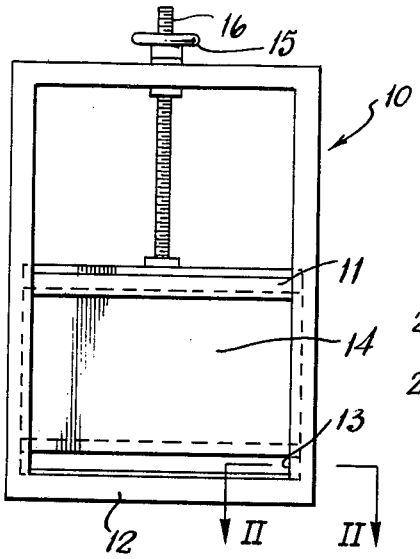
FIG. 1 is an elevation of a penstock.

Referring now to the drawings, the penstock comprises a frame generally indicated at 10 of channel section defining between a cross member 11 and a base invert member 12, an opening 13. A door 14 is adapted to close said opening by sliding vertical movement in the frame 10. A hand wheel 15 and screw 16, for example, may be provided for this purpose.

In each vertical side member of the frame 10 there is provided a pair of vertical guide members 17 and 18. The member 17 comprises one or more vertically spaced rigid strips 19, horizontally adjustable by one or more threaded studs 20 and fixed to the adjacent wall of the frame member. A strip 21 of semi-rigid material such as polyethylene or similar material having a low coefficient of friction is attached to the strip 19 to reduce sliding friction with the face of the door 14.

The member 18 on the other side of the door comprises a strip 22 of semi-rigid material such as polyethylene bonded to the outer face of strip 23 of resilient material such as foamed neoprene which itself is bonded on its inner face to the adjacent wall of the frame member. A steel or other rigid material rod 24 whose diameter is less than the thickness of the strip 23, is set into the resilient strip 23 abutting the surface of said adjacent wall. The rod 24 serves in the operation of the penstock to prevent excessive compression of the resilient strip 23 by forces acting on the door 14 which could otherwise cause the resilient strip 23 to become permanently deformed if held under excessive pressure for long periods.

Although the seal provided by the members 17 and 18, serves to prevent leakage around the side edges of the door, it is necessary similarly to prevent leakage under the lower edge thereof and particularly at the lower corners.

Figure 5:
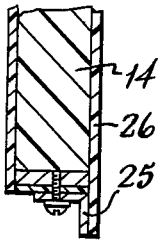
FIG. 5 is a vertical section of the lower edge region of the door of the penstock.

To this end, as can be seen from FIG. 5, the base of the door is presented as a narrow edge by means of an L-shaped reinforcing strip 25 screwed or otherwise attached to the base of the door itself. Also one side wall 26 of the door is preferably extended downwardly to the lower edge of the strip 25.

Figure 2:
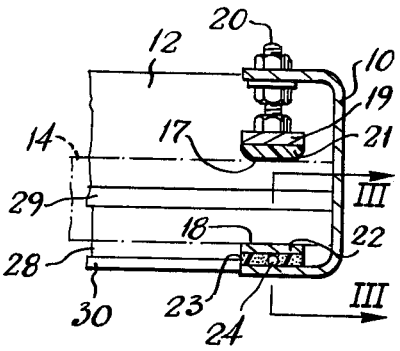
FIG. 2 is a section taken on line II—II of FIG. 1 on an enlarged scale.
Figure 3:
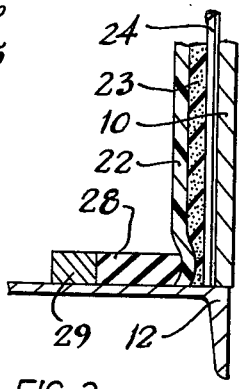
FIG. 3 is a section taken on line III—III of FIG. 2 on a further enlarged scale.

An invert seal, as shown in FIGS. 2 and 3, comprises a strip 28 of resilient material such as a urethane elastomer which extends across the base invert 12 of the frame 10 and is bounded at its side edges by limit strips 29 and 30 of a rigid material such as unplasticised polyvinylchloride.

It will be understood that when the door 14 is in the closed position the resilient strip 23 of the vertical sealing member 18 is at least partially compressed in order to form a tight seal, and it is therefore necessary when forming resilient strip 28 of the invert seal to do so whilst the resilient strip 23 is compressed to the same extent as it would be in use.

Figure 4:
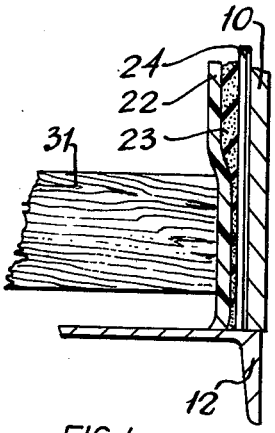
FIG. 4 is a section similar to FIG. 3 illustrating the arrangement thereof prior to forming an invert seal.

To form the invert seal therefore, a support 31 of wood, for example, is temporarily located so as to occupy the position normally occupied by the door, between the lower regions of the sealing members 17 and 18. As can be seen from FIG. 4 the support 31 is of such length that the vertical resilient strip 23 is compressed until the strip 22 almost abuts the rod 24 in the lower end region thereof. The horizontal resilient strip 28 is formed by pouring the selected material in liquid form into the channel which exists between the previously fixed limit strips 29 and 30. Thus the urethane 28 flows around the lower end region of the sealing member 18 to form a bonded seal therewith.

After the urethane has cured, the support 31 is removed so that the parts generally assume the arrangement illustrated in FIG. 3.

It can be seen therefore that when the door 14 is lowered into the closed position its respective side edge regions are sealed against the vertical guide member 18 whilst its lower edge comes into sealing contact with the resilient strip 28, and the compression of the resilient vertical strips 23 ensures that when the door is finally closed each sealing member 18 forms a right-angle with the surface of the resilient strip 28 thus creating a good seal with the corresponding surfaces of the door.

It is not intended to limit the invention to the above example only, many variations, such as might readily occur to one skilled in the art being possible without departing from the scope of the invention.

For example, the rigid guide members 17 can be replaced by resilient seals similar to the members 18.

Figure 6:
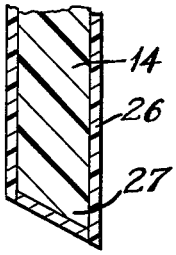
FIG. 6 is a fragmentary view in section like FIG. 5 but showing a modified form of the base of the door.

Furthermore, the base of the door can be other than L-shaped in order to present a narrow sealing edge, and may, for example, be wedge shaped as shown at 27 in FIG. 6.

The various materials used in the sealing strips may be other than those specified, but having similar physical properties. For example, the resilient material forming the strip 28 can be a natural or synthetic rubber compound.

What is claimed is:

1. A method of producing a base invert seal in a penstock of the type comprising a frame having an opening therein and a door slidable within the frame across said opening to close same by vertical movement between fixed vertical guide members slidably engaging the side edge regions of said door until its lower end seats on a base member of the frame extending transversely between the lower ends of said guide members and wherein at least one of said guide members at each side forms a compressed resilient vertical seal with the door side region engaged thereby, the method comprising the steps of positively applying a compressive force for compressing the lower end region of each said one guide member to a condition approximating that to which it would be compressed by the lowered door, forming along said base member a pad of resilient material onto which the lower edge of said door will seat when closed with said resilient material bonding to and forming a seal around the compressed lower end region of each said one guide member, and releasing said positive compressive force.

2. A method according to claim 1, wherein said pad of resilient material is formed by introducing the material in liquid form into a channel defined by spaced limit strips such that said liquid flows around the lower end regions of said one guide members to become bonded thereto, said positive compressive force being maintained until said liquid has cured.

3. A method of producing a base invert seal in a penstock, the penstock comprising a frame, having an opening therein defined by vertical sides and a base, and a door slidable within the frame across said opening to close same by vertical movement onto said base between opposed fixed vertical guide members slidably engaging each side edge region of said door, wherein at least one of said members at each side forms a resilient vertical seal for the door, the method comprising the steps of temporarily at least partially compressing said resilient vertical seals, forming a channel defined by a pair of spaced limit strips extending across said base between said vertical sides, introducing a material in liquid form into said channel which material when cured forms a resilient pad onto which the lower edge of said door in use will close, said liquid material flowing around the lower end region of said resilient vertical seal to form a seal therearound, the temporary compressive force being maintained until said liquid material has cured, the base region of said resilient vertical seal being maintained in a partially compressed state by said resilient pad after said compressive force is removed.

4. A penstock comprising a frame having an opening therein, a pair of opposed fixed vertical guide members on the frame extending along each of the opposite sides of said opening, a transverse base member extending along the bottom of said opening, a vertically movable door having opposite side edge regions extending between the respective pairs of guide members with its opposite surfaces in sliding engagement with said guide members, at least one of the guide members of each said pair at each side edge region of the door being compressible for forming a resilient vertical seal with the door surface engaged thereby, precompressed lower end regions on each said one guide member, and a pad of resilient material upon which the lower edge of the door seats when closed extending along said base member with its opposite ends bonded in sealing relation to said lower end regions of said one guide members, said pad of resilient material maintaining at least partial compression of said one guide members at said lower end regions.

5. A penstock according to claim 4, wherein said pad of resilient material is formed in a channel extending along said frame base and defined by limit strips of a rigid material.

6. A penstock according to claim 4, wherein each said guide member providing the resilient vertical seal comprises a strip of semi-rigid material bonded to one face of a strip of resilient material which itself is bonded on its face remote from said semi-rigid strip to an adjacent fixed frame member.

7. A penstock according to claim 6, wherein a rod of rigid material is set into the resilient strip and abuts the surface of said adjacent frame member, the thickness of said rod being less than the thickness of said resilient strip.

8. A penstock according to claim 7, wherein said rod is of steel.

9. A penstock according to claim 6, wherein said semi-rigid strip is of polyethylene.

10. A penstock according to claim 6, wherein said resilient strip is of foamed neoprene.

11. A penstock according to claim 4, wherein said pad of resilient material is of a urethane elastomer.

12. A penstock according to claim 4, wherein the base of said door is formed as a narrow edge in relation to the thickness of said door, therebeing an L-shaped reinforcing member attached to the base of the door and disposed so as to seal against said resilient pad when the door is closed.

13. A penstock according to claim 4, wherein the lower edge of said door is formed as a narrow edge in relation to the thickness thereof, and is of wedge shaped cross-section.

* * * * *